United States Patent [19]

Bey

[11] 4,429,913

[45] Feb. 7, 1984

[54] SLEEVE TYPE DOOR SECURING DEVICE

[75] Inventor: Henry A. Bey, Breckenridge, Minn.

[73] Assignee: Lena Bey, Wahpeton, N. Dak.

[21] Appl. No.: 234,770

[22] Filed: Feb. 17, 1981

[51] Int. Cl.[3] ..... E05C 19/18

[52] U.S. Cl. ..... 292/293

[58] Field of Search ..... 292/289–298, 292/264

[56] References Cited

U.S. PATENT DOCUMENTS

| | | | |
|---|---|---|---|
| 452,947 | 5/1891 | Morris | 242/291 X |
| 526,683 | 10/1894 | Buckland | 292/289 |
| 605,809 | 6/1898 | Plimpton | 292/293 |
| 967,948 | 8/1910 | Mellott | 292/292 |
| 1,066,770 | 7/1913 | Wanz et al. | 292/296 |
| 1,171,266 | 2/1916 | Simmons | 292/293 |

*Primary Examiner*—Richard E. Moore

[57] ABSTRACT

One end of a thin strong elongated member is hooked into the opening of a striker plate in a door jamb and when the door is closed a sleeve around the elongated member is brought to bear against the door jamb and the door to securely hold the door closed. The sleeve itself is threadably engaged with the elongated member or a wing nut may be used to move the sleeve against the door and the jamb.

3 Claims, 3 Drawing Figures

SLEEVE TYPE DOOR SECURING DEVICE

BACKGROUND OF THE INVENTION

The invention relates generally to portable devices which can be readily attached (and removed) for securely holding a door closed. This would likely be used in addition to conventional locks and bolts which are an integral part of the door, door frame and jamb construction.

My earlier U.S. Pat. No. 4,022,503 dated May 10, 1977, describes a chain type of portable door securing device. Briefly, this earlier device has a thin strong member which hooks onto an edge at the opening of the striker plate located in the door jamb and extends along the door jamb and has a chain at its other end. When the door is closed the chain is wrapped around or attached in some fashion to the door knob. This type of device has some flaws which are overcome by the present device.

Other types of door security devices of a portable nature which have an elongated member which hooks into the opening in the striker plate and utilize a cylindrical member for threadably engaging the elongated member and pressing against the door and door jamb to hold the door closed are shown in the following U.S. Pat. Nos: 894,554; 898,685; 1,188,699; 1,434,411; 3,429,151; 3,494,653. Although all of these security devices work generally on the same principle, each are lacking in some material aspect which the instant invention overcomes.

SUMMARY OF THE INVENTION

A tensilely strong but relatively thin wire member hooks at one end onto an edge in the opening of a striker plate in a door jamb and extends along the door jamb in the direction that the door would normally swing open. An elongated member is pivotally attached to the other end of the wire member and is threaded at least along a portion of its length. A sleeve over the elongated member is brought to bear against the closed door and the door jamb by means threadably engaging the threads on the elongated member. Preferably the wire member is made of piano wire which has the tensile strength necessary to withstand the force which might be encountered if someone were to try to forcibly open the door and at the same time is thin enough to fit into the space between the door jamb and the edge of the closed door. In one embodiment the sleeve is internally threaded to engage the threads on the elongated member and in another embodiment the sleeve slides over the elongated member and a wing nut is threaded onto the elongated member to push the sleeve against the door.

Because of the pivotal attachment between the wire member and the elongated member, the latter can be swung away from the door opening even when the former is hooked onto the striker plate thereby permitting the door to be closed prior to securing it or allowing the door to be opened after the securing device has been released.

By making the threads only partially along the elongated member, the security device can be more quickly released in the event of an emergency.

Another feature is that the portable device is constructed very solidly yet is compact and can be easily carried in a hand or pocket.

DESCRIPTION OF THE PREFERRED EMBODIMENT

Figure 1:
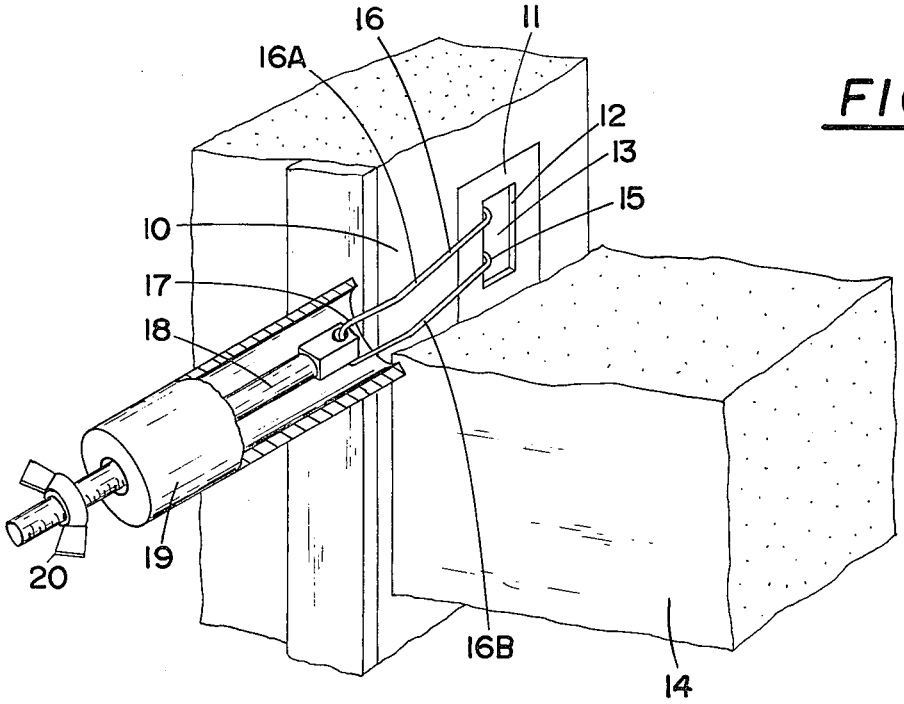
FIG. 1 is a partial cut-away view showing the security device as it would appear in use for securely holding a door closed.
Figure 2:
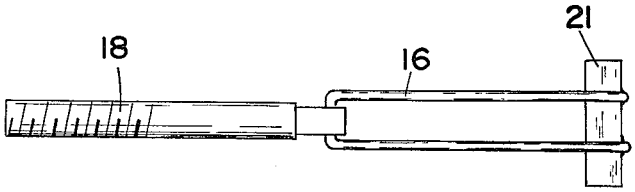
FIG. 2 and FIG. 3 show in detail the hook end of one embodiment of the invention.
Figure 3:
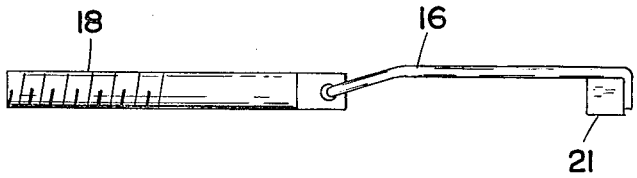

In a conventional fashion a door jamb 10 has a striker plate 11 which has an opening 12 defining a recess 13 in the door jamb for receiving a latch (not shown) for door 14.

One end 15 of a wire member 16 is hooked onto one edge of the striker plate 11 and extends along the door jamb 10 in the direction which door 14 normally swings open. Preferably the wire member 16 comprises two parallel wires 16A and 16B which are piano wires to provide good tensile strength while still being relatively thin to fit in the space between the door jamb and the door when the door is closed. At the opposite end the two wire members 16A and 16B are connected together at eyelet 17 which is pivotally attached to one end of an elongated threaded member 18. The latter may be the shank of a headless bolt.

Surrounding the elongated member 18 is a metal sleeve 19 whose axial opening is large enough to permit the sleeve to slide back and forth along the elongated member 18. Threadably engaged beyond the outer end of the sleeve 19 with the elongated member 18 is a wing nut 20.

To secure the door as illustrated in FIG. 1, the hook end 15 of wire member 16 is first inserted in the opening 13 of striker plate 11 and hooked onto the edge of the plate. Elongated member 18 is pivotally swung away from the door opening and the door 14 is closed. After the door is closed, elongated member 18 is swung back to be in line with the wire member 16 and the wing nut 20 is threaded onto member 18 to puch sleeve 19 against the edge of the door jamb 10 and the edge of the door 14 thereby securely holding the door closed against any outside effort to force the door open.

As a variation, the inner opening of the sleeve 19 may be threaded to engage the threads on the elongated member 18 thereby eliminating the need for wing nut 20. Preferably the elongated member 18 is threaded only for a length sufficient to securely and forcibly have the sleeve press against the door and the door jamb to hold the door securely closed. With fewer threads the securing device can be quickly released in the event of an emergency. Also, the feature of pivotally attaching the elongated member so that it can be swung away from the door opening makes it easier and faster to release the securing device and open the door.

While the hook 15 can be integrally formed by bending the ends of the wire members 16A and 16B, another manner of providing the hook is to rigidly attach a bar of metal 21, such as by welding, across the adjacent ends of the wire member 16A and 16B. This provides additional strength and security for the device.

The embodiment using the two parallel wire members has the further protective feature that in the event there should be a defect in one of the wire members so that it gives way, the other member may still have sufficient strength to hold the door securely closed.

It can be seen that the wing nut 20 and the sleeve 19 can be easily removed and separated from the rest of the device and the elongated member 18 and the wire member 16 swung together so that the entire unit can be packaged very compactly and easily carried in a person's pocket or purse or the like. Also, the device contains no sharp edges or points which could be dangerous when being carried about. The device is relatively simple and inexpensive to manufacture because it does not require any finely machined or precision parts and all of the parts can generally be found in some commercially available form.

I claim:

1. For use with a door which is hingedly mounted in an opening which has a door jamb, an opening in the door jamb for receiving a latch and a striker plate around the opening, there being a space between the side edge of the door and the door jamb even when the door is swung fully closed, a portable device for securing the door when closed comprising:

(a) a pair of tensilely strong parallel spaced-apart piano wire members joined together at one end and having hooking means at the other end for engaging an inner edge of the opening in the striker plate on the door jamb said members extending partway from said other end along the door jamb in a direction which the door normally swings open and then partway angled inward to said one end, the wire members being thin enough to permit the door to close even when the hooking means is engaging the edge of the striker plate opening;

(b) an elongated threaded member pivotally attached at one end to the one end of said wire members whereby the threaded member can be swung away from the door opening to permit the door to be swung open or closed when the hooking means on the wire member is engaging the edge of the striker plate opening;

(c) a sleeve over said threaded member, the outer diameter of the sleeve being substantially larger than the space between the door and the door jamb when the door is closed and the axial opening in the sleeve being larger than the diameter of said threaded member to permit the sleeve to slide over the threaded member; and (d) a wing nut threadably engaging the threaded member for moving the sleeve along said threaded member to securely hold the sleeve against the edge of the door and the door jamb when the door is closed.

2. The door securing device as described in claim 1 wherein said hooking means comprises a solid metal bar rigidly attached between the two adjacent ends of said piano wires.

3. The door securing device as described in claim 1 wherein said wire members are curved inward at their other ends to form said hooking means.

* * * * *